United States Patent [19]

Varin

[11] Patent Number: 4,888,852

[45] Date of Patent: Dec. 26, 1989

[54] VACUUM CLEANER SUCTION HEAD FOR PICKING UP THREADS

[75] Inventor: Michel Varin, Crepy-en Valois, France

[73] Assignee: Establissements Georges Olivier S.A., Paris, France

[21] Appl. No.: 54,589

[22] Filed: May 27, 1987

[30] Foreign Application Priority Data

May 30, 1986 [FR] France ..... 86 07812

[51] Int. Cl.[4] ..... A47L 9/06

[52] U.S. Cl. ..... 15/400; 15/373

[58] Field of Search ..... 15/398, 400

[56] References Cited

U.S. PATENT DOCUMENTS

| | | | |
|---|---|---|---|
| 2,703,903 | 3/1955 | Faith-Ell | 15/400 X |
| 3,745,605 | 7/1973 | Gitschel et al. | 15/400 |
| 3,820,189 | 6/1974 | Roth | 15/400 |
| 3,833,962 | 9/1974 | Krusche | 15/400 |
| 4,319,379 | 3/1982 | Carrigan et al. | 15/400 |

FOREIGN PATENT DOCUMENTS

| | | | |
|---|---|---|---|
| 1085915 | 10/1957 | France | 15/400 |
| 1214665 | 11/1959 | France | 15/400 |
| 7315595 | 11/1973 | Netherlands | 15/400 |

*Primary Examiner*—Chris K. Moore

*Attorney, Agent, or Firm*—Marshall & Melhorn

[57] ABSTRACT

The suction head comprises a housing (1) provided with a suction tube (2) and closed by a bottom sole plate (4) which has at least two longitudinal channels in the form of grooves communicating with the tube via at least one window (14). According to the invention, at least one removable blade (19) carrying a thread-pickup cloth (20) having oriented fibers is suitable for being received in one of the channels and for at least partially obstructing a window, with the fibers being directed towards the window which is left unobstructed.

10 Claims, 12 Drawing Sheets

VACUUM CLEANER SUCTION HEAD FOR PICKING UP THREADS

The present invention relates to a vacuum cleaner suction head having at least two longitudinal suction channels.

BACKGROUND OF THE INVENTION

One such suction head presently used comprises a housing 1 made of plastics material, and has a pivotally-mounted suction tube 2 on the back thereof opening out into a well 3 which is integrally molded with the housing 1.

A metal sole plate 4 is fixed beneath the housing 1 by means of screws 5 and together the housing 1 defines a slot 6 through which a retractable peripheral brush 7 may be extended.

Two longitudinal channels 8 and 9 are formed as grooves in the sole plate 4 and are separated by a ridge 10 which does not project quite all the way to the sliding surface of the sole plate 4 so as to enable a small degree of leakage to take place between the two channels.

The front channel 8 is substantially rectilinear, however its cross-section tapers from a middle zone having an aperture 11 towards its ends where it opens out to the sides via passages 12 and 13. In contrast, the rear channel 9 is in the shape of a plane trapezoidal arc having an aperture 14 provided in the central core thereof, and having branches 15 and 16 which are splayed out forwardly and which are closed at their free ends.

The apertures 11 and 14 separated by the ridge 10 open out into the well 3 of the housing 1 and are therefore in communication with the pivoting tube 2, thereby enabling suction appropriate to normal cleaning to be set up beneath the suction head via the channels 8 and 9.

In addition, narrow thread-pickup plates 17 and 18 are permanently fixed, e.g. by gluing, in recesses formed as grooves over a portion of the length of the sole plate 4 along its front and back margins. These pickup plates are covered by cloth having directed fibers and they are positioned so that the fibers are directed towards the apertures 11 and 14.

Wessel's German patent application No. 2 220 815 relates to another suction head of this type. The following description made with reference to FIG. 5 of the accompanying drawing relates solely to the items of the sole plate which distinguish the Wessel suction head from the Olivier suction head. The sole plate 24 has two substantially rectilinear longitudinal channels 25 and 26 which are separated by two ridge elements 30 having a passage 31 provided therebetween with the top horizontal wall thereof being situated at substantially the same level as the level of the channels. An aperture 32 is provided in said sole plate and extends across the front channel 26 into the passage 31 and just reaches the rear channel 25.

These prior art suction heads are unsuitable for picking up and vacuuming fibrous substances such as hairs or threads from a mat or carpet to which they may be attached in relatively large quantities after a sewing session or after a dog or an other hairy animal has been in the room.

Schwab's German patent application No. 2 100 465 describes a household implement for picking up and swallowing threads or hairs, etc. from mats, carpets, or the like to which they may have become attached. This implement may be a mechanical carpet sweeper having one or two rotary brushes, or else it may be a nozzle for a vacuum cleaner. The sweeper or the nozzle is fitted under its sliding surface with two pieces of padding which are covered with the above-mentioned cloth having oriented fibers. The padding is adapted to extend along the inlet openings in such a fashion that if the implement is a one-brush sweeper the padding is situated on either side of the longitudinal opening through which the brush acts; if the implement is a two-brush sweeper, the padding is placed between the longitudinal openings through which the brushes act; and if the implement is the nozzle of a vacuum cleaner, the padding is disposed on either side of the very deep longitudinal opening which is connected to the suction tube. In each case, the sloping fibers on one of the pieces of padding are directed forwardly and on the other piece of padding they are directed rearwardly, with the pieces of padding being located so that the fibers are simultaneously directed towards the common opening or towards the two openings.

A Schwab suction nozzle fitted in this way has already been exploited commercially, thereby showing up its advantages and its drawbacks.

The advantage of such equipment lies in its effectiveness in extracting hairs or threads from carpets, with greater efficiency than the above-mentioned prior suction heads.

However, a first drawback of the Schwab's equipment lies in abnormal wear of the carpet under prolonged use, and also in poor suction of the threads or hairs and of the dust picked up from the carpet. As a result it is necessary to have both the Schwab equipment and a conventional suction head of the above-mentioned type available simultaneously, with the Schwab equipment being used rarely and solely for extracting threads and hairs from carpets, mats, etc. when the threads or hairs are present in relatively large quantities, while the prior suction head is used for removing dust from all kinds of floor, including carpeted floors.

A second drawback of the Schwab suction head lies in the fact that it is too difficult to move so that operating it is hard work and tiring, which can lead users making do without it. Further, demonstrators are well aware of this drawback, and to remedy it they raise the carpet to be treated so that the handle of the equipment is at a smaller angle than it would be in normal use, thereby making it considerably easier to operate.

The aim of the present invention is to remedy these drawbacks by improving a prior suction head of the above-mentioned type or of any other type having the same characteristics. The only requirement is that the sole plate has at least two longitudinal suction channels in communication with the suction tube via at least two openings constituted by two horizontal apertures or at least by one horizontal aperture and a vertical passage.

SUMMARY OF THE INVENTION

According to the invention, at least one removable blade bearing a thread-pickup cloth having oriented fibers is intended, when the suction head is used for picking up threads under suction, to take up a position in one or more suction channels selected from those present in the sole plate while partially obstructing at least the corresponding opening, the blade is positioned so that the fibers of the cloth are oriented towards the opening left free and extend, when at rest, substantially to the level of the sliding surface of said sole plate, with at least the selected channel being released, when the suction head is used solely for vacuum cleaning, so that suction can propagate therein at least from the corresponding opening.

In one particular case, the blade is removable and is dismountably fixed, when in use, in the selected channel.

In another particular case, the blade is retractable and is connected to an actuator mechanism integrated in the suction head and controlled by at least one external operating member such as a pedal, a pushbutton, etc., with the mechanism displacing the blade between two positions, and maintaining the blade in each of the two positions which are constituted by the above-mentioned in-use position in which the blade is lowered into the channel, and by an out-of-use position in which the blade is raised to constitute a wall portion of the corresponding channel whose rims provide sealing around the blade.

When the thread-pickup blade is in place, the improved suction head, in accordance with the invention, extracts threads and hairs from carpets with remarkable efficiency, comparable to that of a Schwab implement. When the thread-pickup blade is removed or retracted, the improved suction head, in accordance with the invention, operates normally for removing dust from any kind of floor, since it then corresponds to an unmodified version of one of the above-mentioned prior art suction heads.

Standardized tests have shown that the dust-removal rate is substantially the same in both cases: i.e. with or without said blade in its operating position, and it should be understood that when the blade is in its operating position, then hairs and threads are also removed.

This result is remarkable and unexpected. Perhaps it is due to the "mechanical" action of the inclined fibers of the cloth on the tufts of the carpet. In any event, it shows that this equipment in accordance with the invention is effective regardless of the mode in which it is used, and without premature carpet wear.

In addition, and in spite of effective dust removal, the resistance of a suction head fitted with such a blade to being displaced remains within reasonable limits, such that using the suction head with the blade in place gives rise to hardly any additional user fatigue.

In Schwab's German patent application No. 2 100 465, it is specified that the pieces of padding having oriented fibers are removable for replacement when worn out or for the purposes of interchangeability. In another case, it is provided that one of the pieces of padding may be absent so that the two-brush carpet sweeper operates solely as a dust-collector on that side. However, it is important to observe that the removable pieces of padding never obstruct the suction or brushing openings when they are in place. As a result there is no interference between the means used (thread pick-up and brushing or suction) and the results obtained, as is the case in the present invention where the sole blade is received in a suction channel and partially obstructs at least one horizontal aperture or one vertical suction passage.

Advantageously, the thread-pickup blade is capable of being firmly received in the rear channel so that threads or hairs are picked up when the suction head is pushed forwardly.

The blade may be shaped to follow a trapezoidal arc, with its side branches diverging forwardly from a middle branch intended to obstruct, at least partially, the aperture in the corresponding channel.

The blade may also be rectilinear and optionally provided with positioning means so that its fibers are properly directed.

In a particular embodiment, the sole plate includes three channels with at least the two outer channels opening out into two respective apertures, and the thread-pickup blade being suitable for being received in the middle channel.

In this embodiment, the fibers of the blade may all be directed towards the front channel or towards the rear channel so that hairs or threads are picked up only when the suction head is pushed forwardly or is pulled backwardly, as the case may be.

In this same embodiment, the blade may also have two contiguous longitudinal strips of thread-pickup cloth, with the fibers of one strip being directed towards the rear channel and the fibers of the other strip being directed towards the front channel so that the suction head picks up threads both when going forwards and when going backwards.

Regardless of the implementation chosen, when the blade is removable it may be provided with a rear extension which is received in a notch in the sole plate and which projects rearwardly in order to enable the said blade to be removed.

Another type of support may be used for receiving the strip of thread-pickup cloth. It may be a removable cover capable of being fitted over the housing and of being snap-fastened thereto in order to overlie at least the suction channel opposite which the thread-pickup strip is situated so as to make it substantially inoperative, the cover having at least one opening level with the other channel(s) in order to leave it (them) at least partially unobstructed.

Advantageously, a removable thread-pickup blade, regardless of whether it is straight or arcuate in the form of a trapezium, has at least one projecting rib suitable for being received as a push-fit in the corresponding aperture in order to constitute a dismountable fastening. The rib may be U-shaped and co-operate with an inwardly directed rim of the sole plate delimiting the said aperture.

Further, regardless of the selected embodiment, when the blade is retractable, it may be provided with small columns passing through the wall of the corresponding channel and guided in translation in sheaths provided in the housing, said blade co-operating firstly with at least one spring bearing against the sole plate in order to urge the blade upwardly, and secondly with an actuator finger fixed to a sleeve rotatably mounted about the vacuum tube and provided with two pedals mounted on either side.

BRIEF DESCRIPTION OF THE DRAWINGS

Embodiments of the invention are described by way of example with reference to the accompanying drawings, in which.

MORE DETAILED DESCRIPTION

Figure 1:
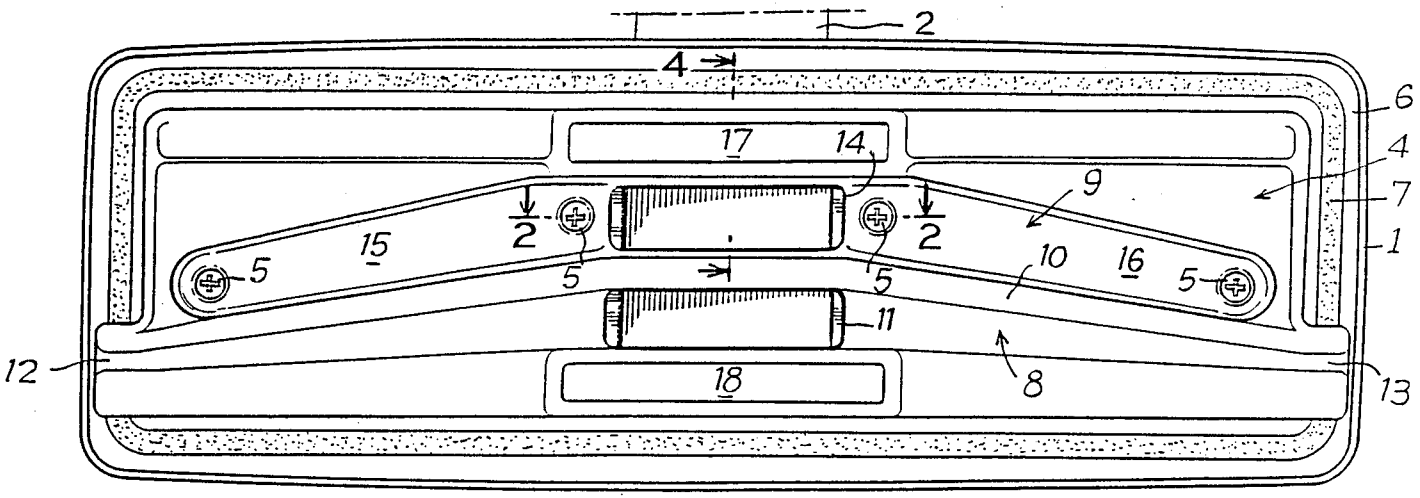
FIG. 1 is a plan view of a first embodiment of a vacuum cleaner suction head as seen from beneath, said suction head being intended to be fitted with a removable thread-pickup blade in accordance with the invention.

In the first embodiment described above with reference to FIGS. 1 to 4, a removable blade 19 (FIG. 3) of plastics material, of stiff card, or of other suitable material, is shaped to match the arcuate channel 9 in order to be received therein, and is covered, at least on its visible face, with a thread-pickup cloth 20 whose oriented fibers are directed towards the aperture 11.

The blade 19 covers the aperture 14 and it is held in place independently of any force exerted by suction through said window by being firmly received in the channel 9, and even by being a push-fit therein. In this position with the blade received in the channel, the tips of the fibers of the cloth 20 when at rest are substantially at the same level as the sliding surface of the sole plate 4.

Figure 2:
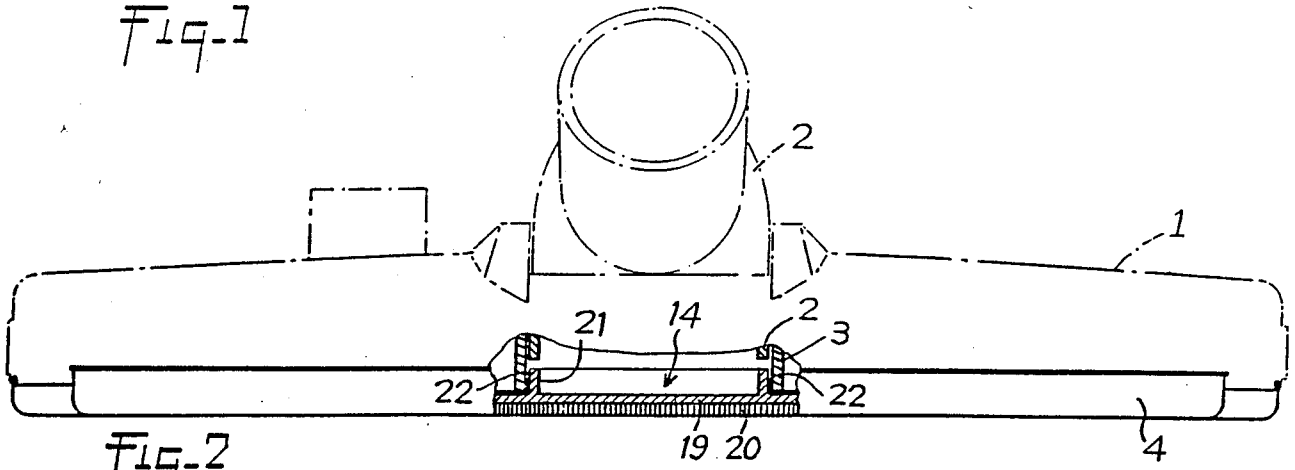
FIG. 2 is a fragmentary elevation partially cut away on line II—II of FIG. 1 and showing the suction head fitted with a blade.
Figure 3:
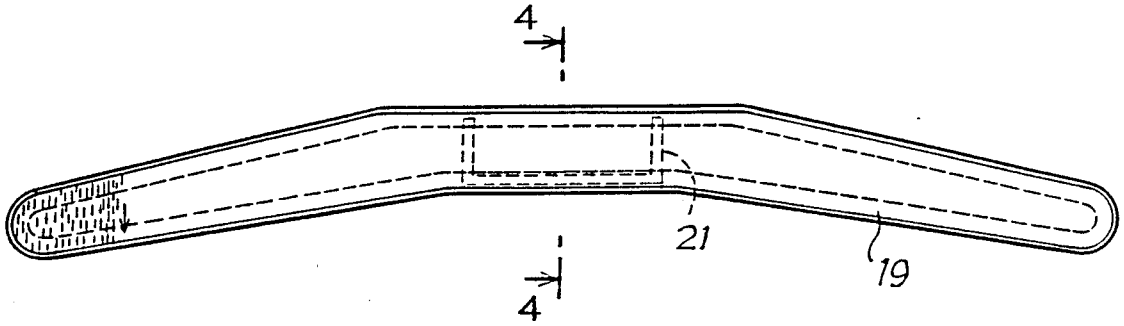
FIG. 3 is a plan view showing the underside of the blade for mounting beneath the FIG. 1 suction head.
Figure 4:
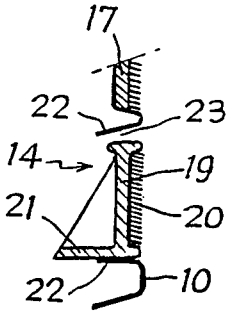
FIG. 4 is a cross-section taken on line IV—IV of FIGS. 1 and 3.

Further, and as can be seen in FIGS. 2 to 4, a rib 21 may project from the blade to be snap-fastened in the aperture 14.

In the example shown, the rib 21 is U-shaped and is received in an inwardly directed rim 22 of the sole plate 4 delimiting the aperture 14, with the rim overlapping the well 3. As can be seen in FIG. 2, the height of the rib 21 is determined so that it does not prevent the tube 2 from pivoting.

Naturally, the fact that the blade 19 is arcuate and is covered with cloth 20 on one face only, ensures that there is no need to take precautions about the position it is to take up, since the fibers on the cloth 20 will always be properly oriented.

Further, it is very easy to remove the blade 9 by sliding a thin tool such as a knife or screwdriver into the slot 23 (FIG. 4) provided between said blade 20 and the rim 22 of the aperture 14 adjacent to the thread-pickup plate 17 and to apply leverage.

The first embodiment applies regardless of whether the suction head includes a brush 7 or of whether the tube 2 is pivotally mounted or is fixed. The same applies for the other embodiments described below.

In the second embodiment described below with reference to FIG. 5, a rectilinear thread-pickup blade 29 which is symmetrical in shape about its longitudinal middle axis 27 which extends perpendicularly to the forward direction, is received in the channel 25 and obstructs the vertical portion of the passage 31 but not the aperture 32. In order to hold the blade 29 in said channel in a removable manner and to position it correctly so that the fibers of its cloth 20 are directed towards the aperture 32, this blade is provided with two "keying pegs" 33 which are asymmetrically situated about the central forward axis 28 of the suction head and which are intended to be received in holes in the sole plate.

Figure 5:
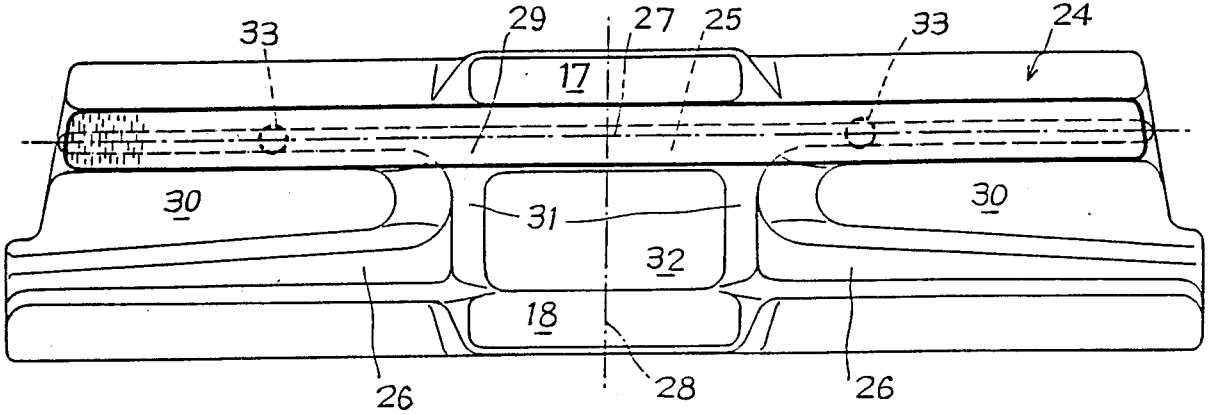
FIGS. 5 to 9 are similar views to FIG. 1 showing other embodiments of a suction head drawn in fine lines, with the head being equipped with a removable thread take-up blade drawn in heavy lines.
Figure 6:
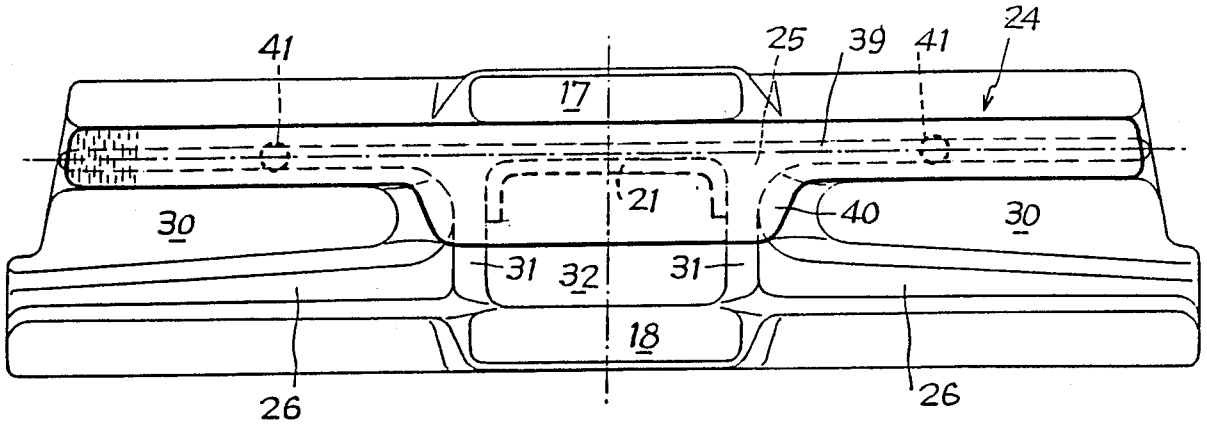

In the variant shown in FIG. 6, the sole plate 24 is similar to that of FIG. 5, except that the aperture 32 also extends across the channel 25. The sole plate 24 then co-operates with a thread-pickup blade 39 which is similar to the blade 29 of FIG. 5 except that it includes a forwardly extending middle portion 40 for being received in the passage 31 between the ridge portions 30 and to partially obstruct the aperture 32.

The blade 39 is held in place in the same manner as the embodiment of FIGS. 1 to 4 by a rib 21 projecting from said blade and being firmly received in the aperture 32. Proper orientation is thus automatically provided. However, pegs 41 may still be provided in order to improve fixing either in conjunction with or instead of the rib 21.

The ridge portions 30 may be relatively short, thereby increasing the length of the passage 31, and the aperture 32 may open out at least in part into the channel 25. In this particular case, the removable blade 29 remains effective when it is mounted and the suction head is likewise effective when it is not mounted.

Figure 7:
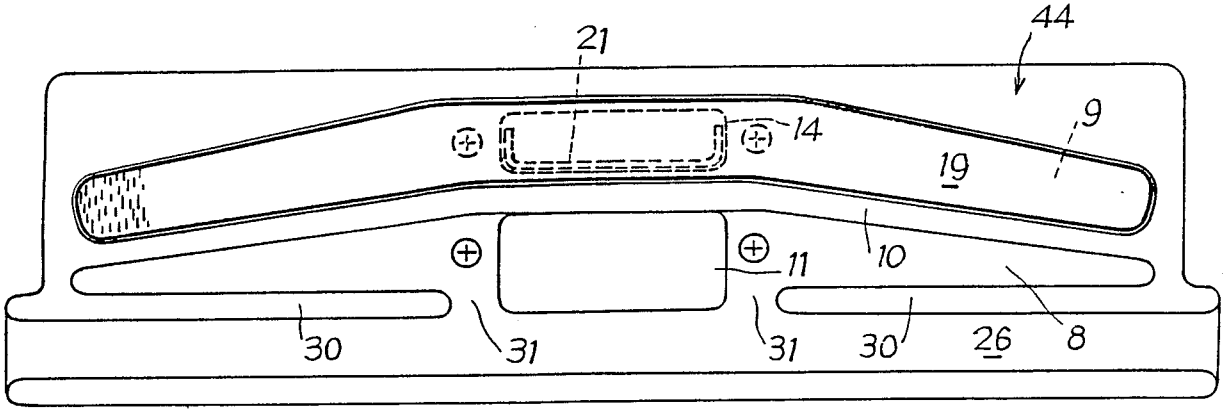

In a third embodiment shown in FIG. 7, the three-channel sole plate 44 combines the channels of the sole plates 4 and 24. Thus, there are the channels 8 and 9 of the sole plate 4 separated by the uninterrupted ridge 10, together with the arcuate blade 19 closing the aperture 14 of the channel 9 and removably fixed thereto by means of the rib 21 centered in said aperture. The channel 8 is similar to the channel 25 of the suction head 24 and communicates with the channel 26 via the passage 31 which extends between the ridge portions 30. The aperture 11 of the sole plate 4 is situated in the middle channel 8 in the sole plate 44, but it now extends into the passage 31 as in the sole plate 24. The advantageous suction and thread pickup effects of the two improved suction heads shown in FIGS. 1 to 4 and 5 are thus combined.

Figure 8:
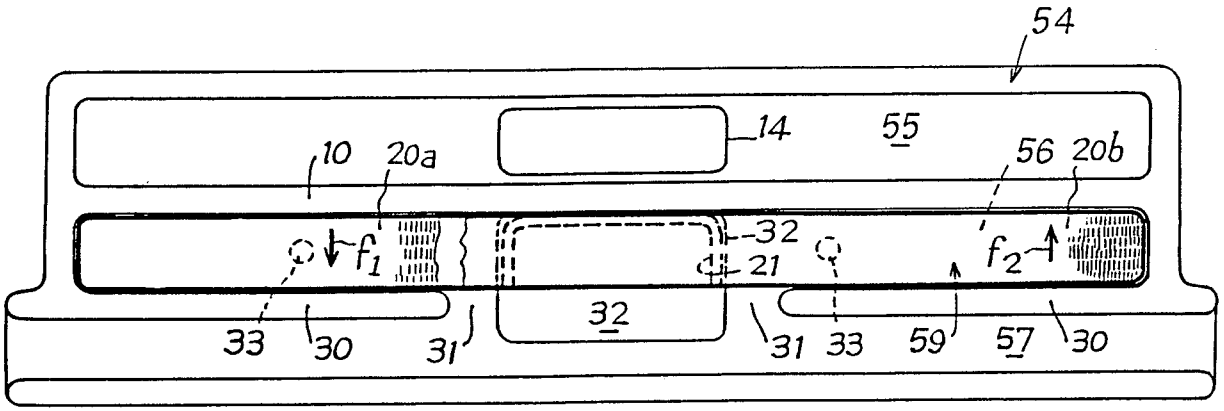

In a fourth embodiment shown in FIG. 8, the sole plate 54 has three channels 55, 56, and 57 as does the sole plate 44. However the channels are now rectilinear and the blade 59 is received in the middle channel 56. The outer channel 55 includes the aperture 14 and is separated from the middle channel 56 by the uninterrupted ridge 10. The outer channel 57 is separated from the middle channel 56 by the ridge portions 30 which extend from either side of the passage 31, with the aperture 32 being provided in said channel 56, the passage 31, and a portion of the length of the channel 57.

In this fourth embodiment, the blade 59 may be covered with a single strip of thread-pickup cloth 20*a* or 20*b* having its fibers sloping either forwardly or backwardly in order to pick up threads or hairs when the suction head is pushed (arrow f1) or pulled (arrow f2). The blade 59 is provided with a fixing rib 21, and if the user is careful, it may be mounted with the cloth positioned as at 20*a* or at 20*b* simply by turning it round so that the U-shaped rib is open forwardly or backwardly.

If the suction head is fitted with two blades 59, having respective strips 20*a* or 20*b*, these blades must be provided with "keying pegs" 33. This disposition is particularly advantageous since it enables the user to continue working with acquired reflexes.

Figure 9:
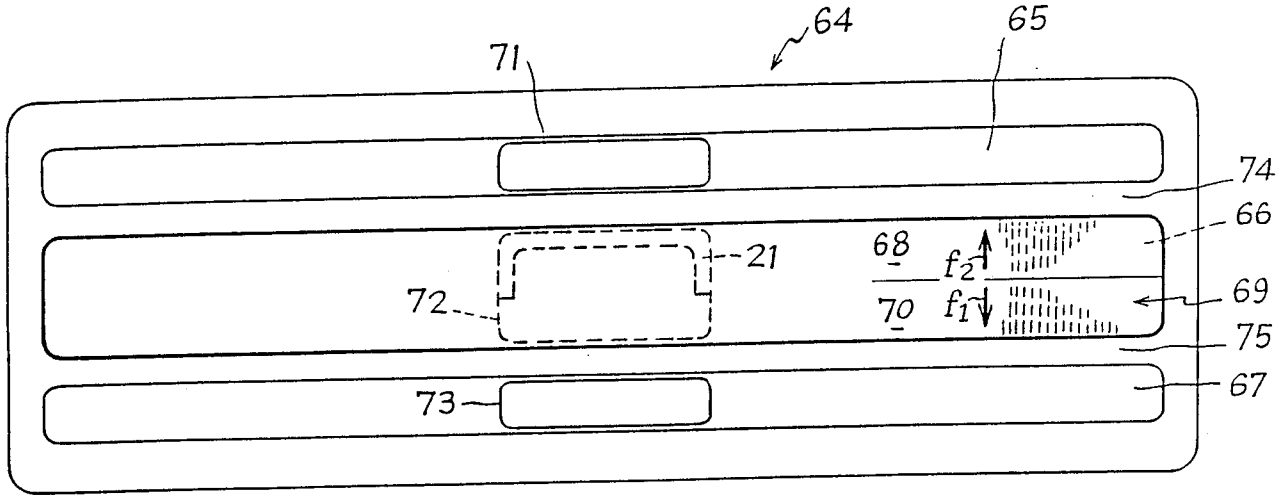

In a fifth embodiment shown in FIG. 9, the sole plate 64 has three rectilinear channels 65, 66, and 67, having respective suction apertures 71, 72, and 73 opening out therein and separated by uninterrupted ridges 74 and 75.

A thread-pickup blade 69 is mounted in the middle channel 66 in removable manner by means of the rib 29 centered in the aperture 72.

This blade may be provided, as in the fourth embodiment, with strips 20*a* or 20*b*, and it may optionally be provided with "keying pegs" 33 (not shown).

Advantageously, it is provided with two contiguous longitudinal strips 68 and 70 of thread-pickup cloth whose fibers are oriented symmetrically in the directions of arrows f1 and f2 so that the fibers of the strip 68 are directed towards the aperture 71 and the fibers of the strip 70 are directed towards the aperture 73. As a result, the blade 59 can pick up threads both when the suction head is moved forwardly and when it is moved backwardly. The picked up threads are then taken up by the suction head regardless of its direction of displacement.

Naturally, the blade 69 having symmetrical strips 68 and 70 may be narrower and mounted in the middle channel 56 of the fourth embodiment as shown in FIG. 8. In this case, keying pegs 33 are pointless.

The blades 19, 29, 39, 59, and 69 described above may be removed by means of a thin tool slid into the slot 23 (see FIG. 4).

Figure 10:
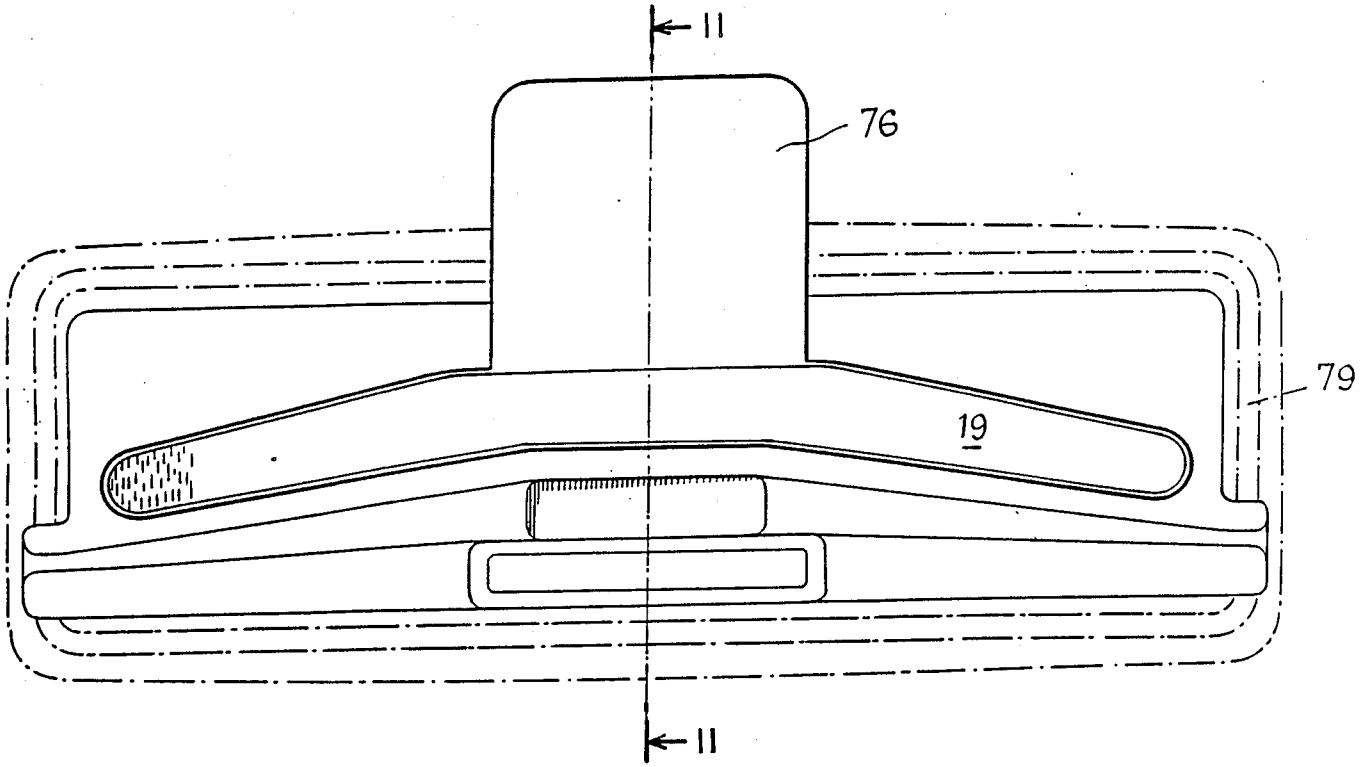
FIG. 10 is a view similar to FIG. 1 showing an improvement applicable to removable thread take-up blades regardless of the shape or location thereof.
Figure 11:
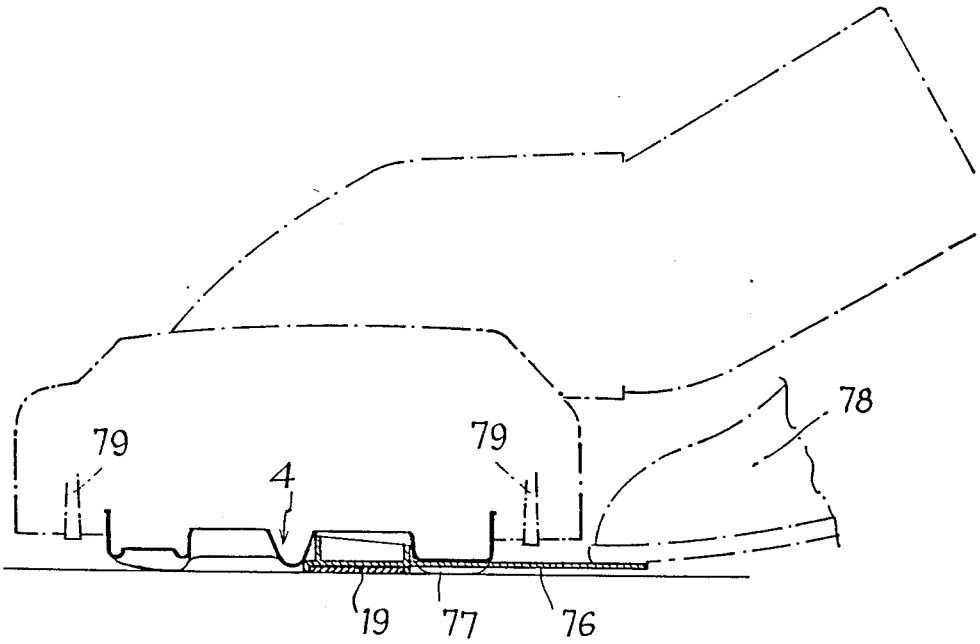
FIG. 11 is a cross-section on line XI—XI of FIG. 10.

They may also be removed by means of extensions 76 on the blades themselves. Such an extension is shown for the blade 19 in FIGS. 10 and 11. The extension projects across a notch 77 in the sole plate 4 and projects rearwardly therefrom. Thus, the blade may be removed by applying pressure to said extension 76 either directly with the foot 78, or else indirectly by means of the peripheral brush 79 of the suction head which is caused to extend around the sole plate by applying foot pressure to a pedal provided for that purpose.

Figure 12:
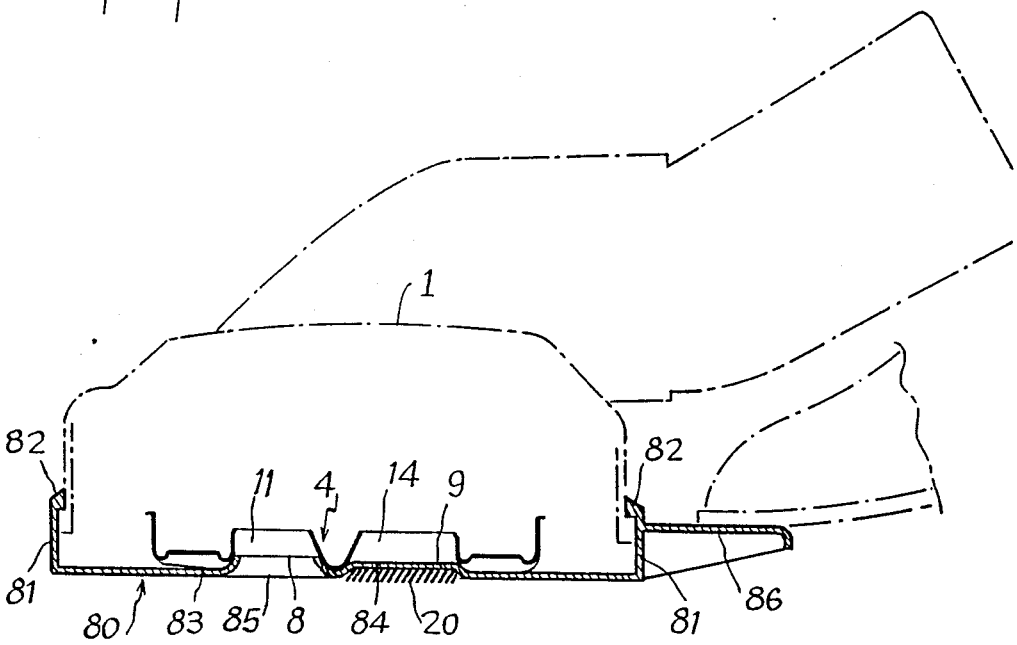
FIG. 12 is a view similar to FIG. 11 but relating to a sixth embodiment of a removable support for thread-pickup cloth.

The removable blade 19, 29, 39, or 69 which is intended: to support a thread-pickup cloth 20; to close one of the suction channels 9, 25, 56 or 66; and to at least partially obstruct the corresponding aperture 14, 32, or 72; may be replaced, as can be seen from the sixth embodiment shown in FIG. 12, by a cover 80 which is preferably made of molded plastics material. The cover has a rim 81 suitable for snapping onto the housing of the suction head 1 and of being held resiliently thereon by means of hooks 82. In this position, the bottom 83 of the cover is pressed against the sole plate 4.

In the example shown in FIG. 12, the cover 80 matches the embodiment shown in FIGS. 1 to 4. In this case, the bottom 83 includes both a raised portion 84 for being received in the channel 9 of the sole plate and for obstructing the window 14, and also a slot 85 situated level with the channel 8. The cloth 20 of oriented fibers is fixed in the outwardly directed trough under the raised portion 84. In addition, an extension 86 projects rearwardly to enable the cover 80 to be removed by applying foot pressure thereto.

Naturally, if the sole plate includes three channels, two of the channels may be removably closed by cloth 20. To this end, the cloth may be fixed beneath the cover 80 or beneath blades of the above-described type but which are interconnected by cross-pieces extending above the sliding surface of the sole plate 4 in the passages interconnecting the corresponding channels.

The above description with reference to FIGS. 1 to 12 relates to suction heads fitted with thread-pickup blades 19, 29, 39, 59, and 69 which are removable and suitable for being removed either by means of a tool or by using a foot.

Figure 18:
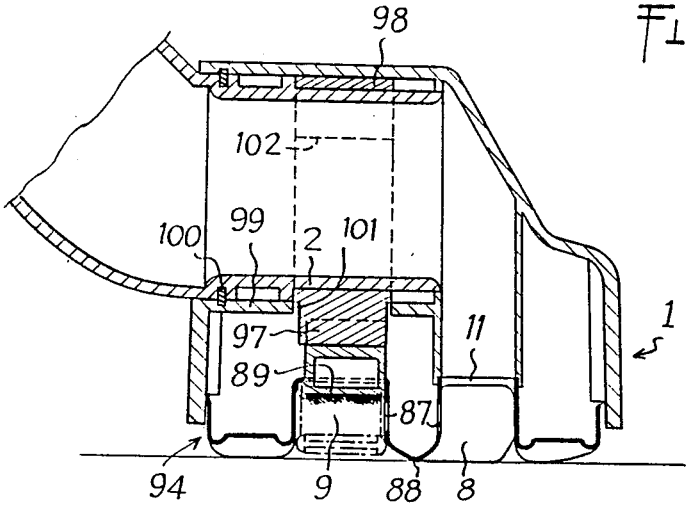
FIGS. 16 to 18 are views similar to FIGS. 13 to 15 respectively, showing a variant embodiment.
Figure 15:
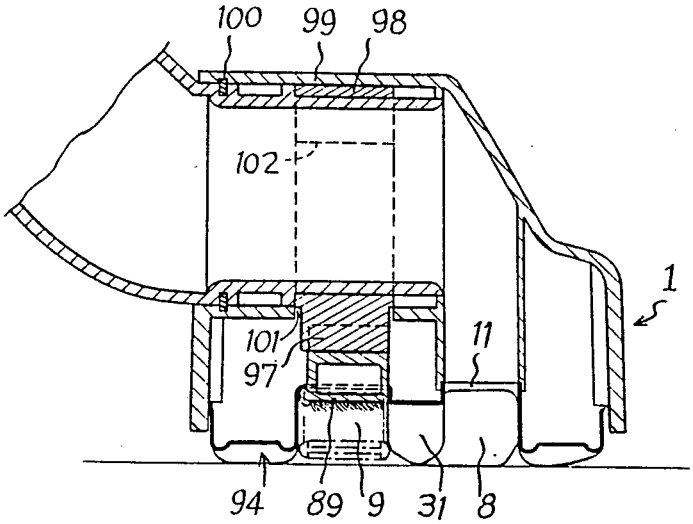
FIG. 15 is a section on a line XV—XV of FIG. 14.

It may be advantageous for the thread-pickup blade to be retractable into the housing 1 in a rising movement and to constitute the far wall of the channel in which it is mounted when the suction head is used for removing dust (the position shown in solid lines in FIGS. 15 and 18), said blade obstructing said channel and lying substantially level with the sliding surface of the sole plate 94 when the suction head is used for picking up threads (position shown in dot-dashed lines in said FIGS. 15 and 18).

Figure 13:
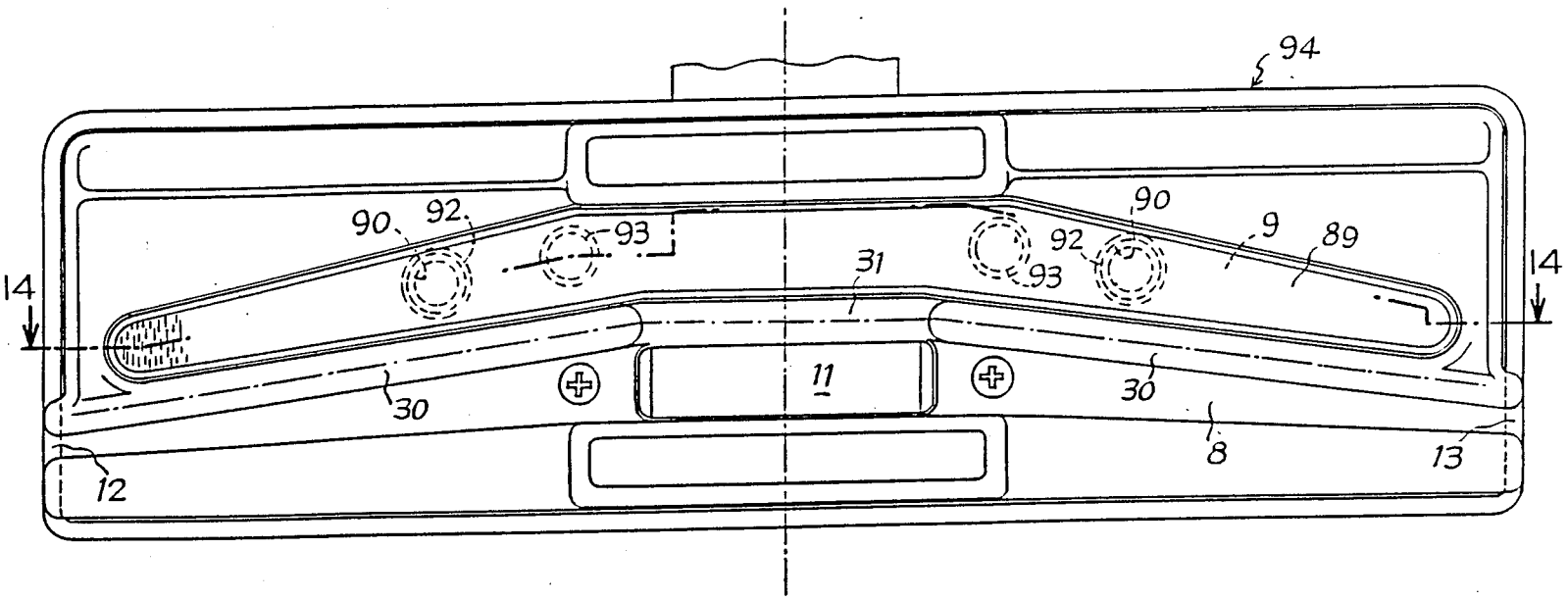
FIG. 13 is a plan view showing the underside of a seventh embodiment of a vacuum cleaner suction head suitable for fitting with a retractable thread-pickup blade in accordance with the invention.
Figure 14:
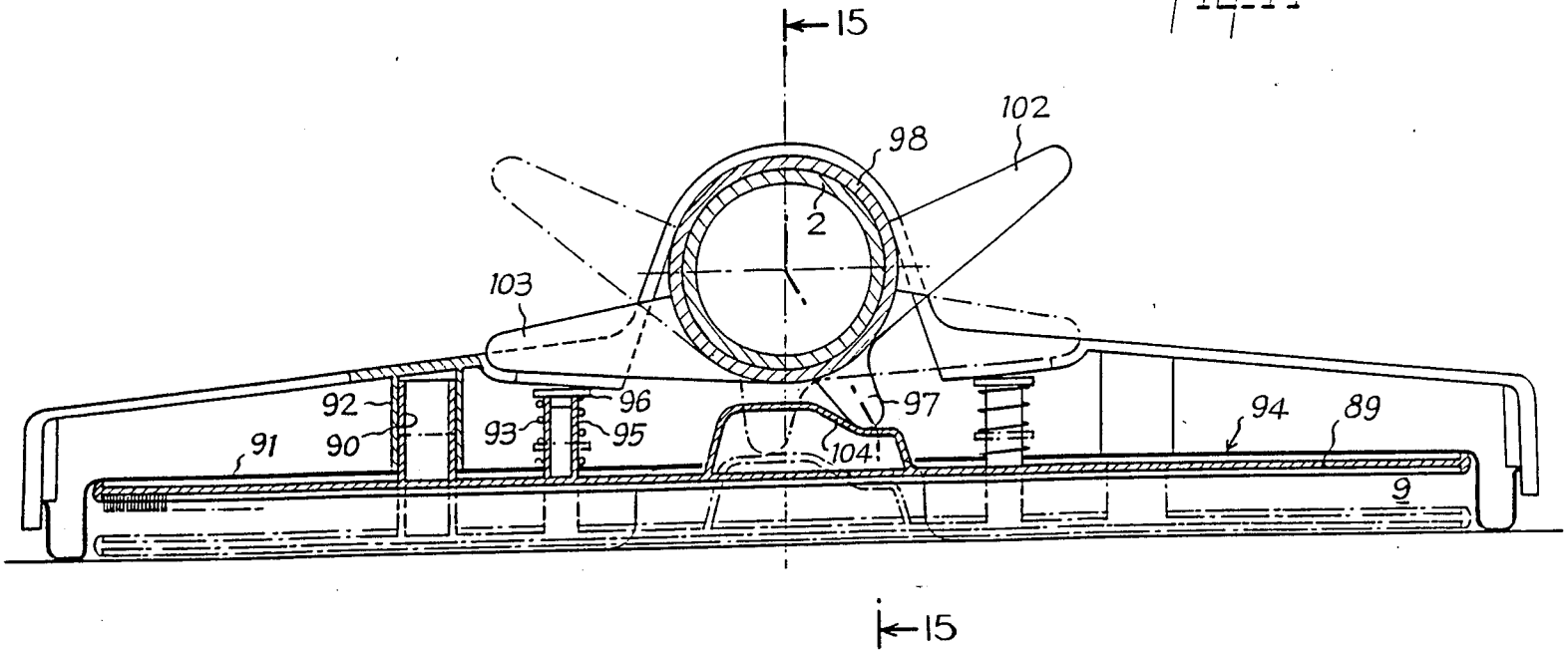
FIG. 14 is a staggered section on a line XIV—XIV of FIG. 13.
Figure 16:
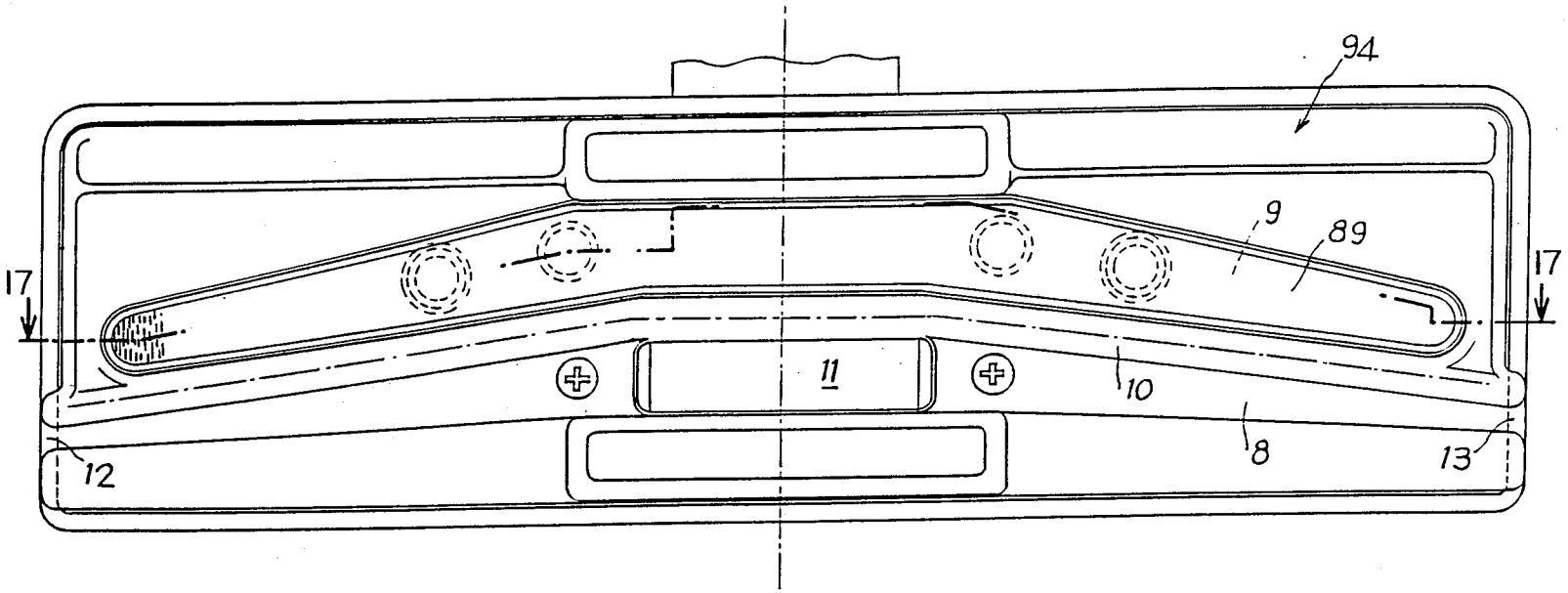
Figure 17:
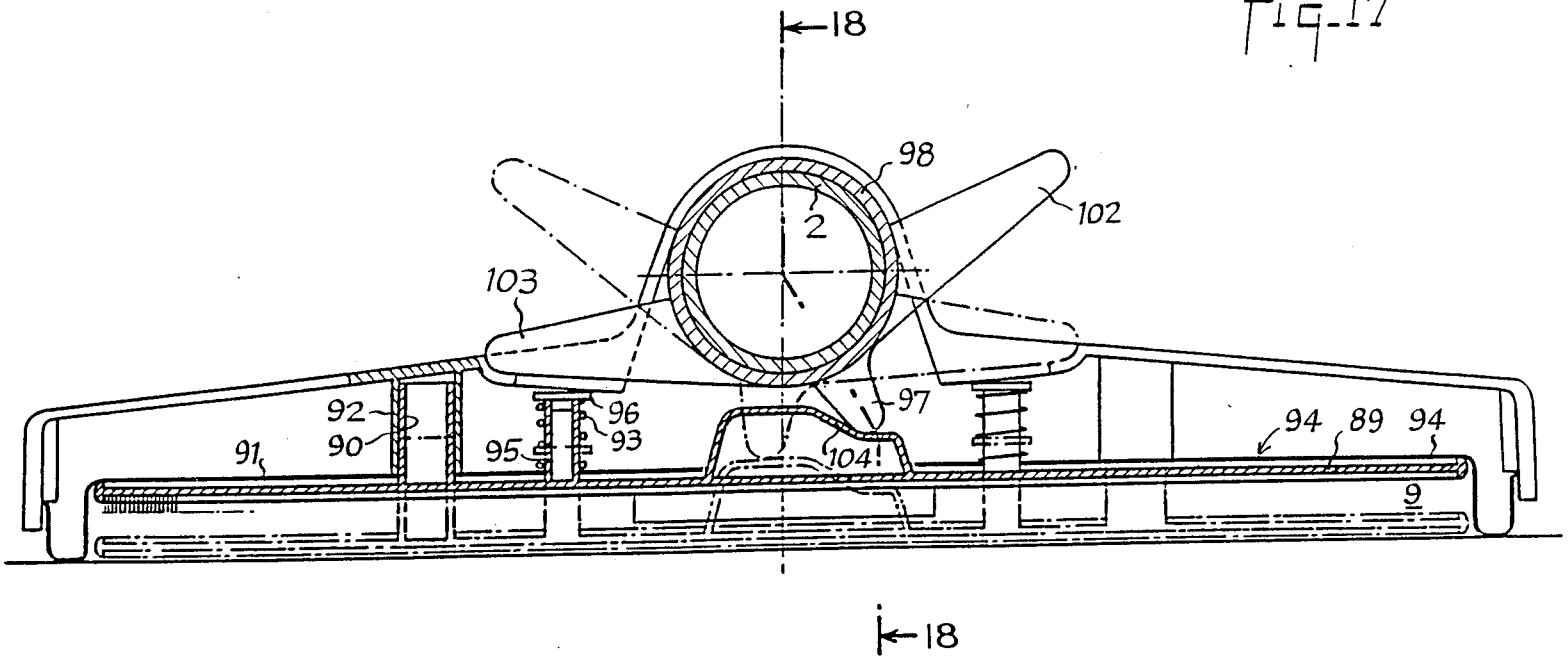

Such a retractable blade 89 is shown in FIGS. 13 to 15 for a seventh embodiment of the suction head and in FIGS. 16 to 18 for a variant thereof.

In the seventh embodiment, the sole plate 94 of the suction head delimits two channels 8 and 9 having the same shape as those of the first embodiment shown in FIGS. 1 to 4. The front channel 8 opens out into the sides of the suction head via end passages 12 and 13 and is in communication with the suction tube via the window 11.

However, as in the second embodiment shown in FIG. 5, the channels 8 and 9 are separated from each other by ridge portions 30 having a central passage 31 provided therebetween. This vertical passage provides communication between the front channel 8 and the rear channel 9, which rear channel does not have a horizontal aperture.

In this seventh embodiment, the top wall of the rear channel 9 is constituted by the blade 89 when in its upper position as shown in solid lines in FIGS. 14, 15 and 17, 18. Vacuum, i.e. reduced pressure, propagates from the aperture 11 directly into the front channel 8 and via the passage 31 into the rear channel 9.

In a variant embodiment shown in FIGS. 16 to 18, the channels 8 and 9 are separated from each other by an uninterrupted ridge 10. As can be seen clearly in FIG. 18, vertical passages are constituted by openings 87 cut out in the walls of the ridge 10 above the tip 88 thereof. This tip is thus not interrupted over the entire length of the suction head and therefore continues to perform its function of "massaging" the tufts of the carpet. Nevertheless, the passages 87 establish communication between the rear channel 9 and the front channel 8 with its aperture 11 when the blade 89 is raised to its upper position.

In both the embodiment shown in FIGS. 13 to 15 and in the embodiment shown in the FIGS. 16 to 18, the blade 89 co-operates with an actuator mechanism integrated in the suction head and enabling said blade to be displaced between the above-specified two positions while being held positively at least in its lower or thread-pickup position.

In the example shown, the blade 89 is integral with two small vertical columns 90 passing through the top wall 91 of the channel 9 in the sole plate 94, said columns being guided in translation above the wall in sheaths 92 integrally mounted with the housing. The blade can thus be moved bodily up and down.

The actuator mechanism includes two springs 93 for resiliently returning said blade towards its raised or retracted position shown in solid lines. The blade is integral with two hollow rods 95 also passing through the top wall 91 of the channel 9 and projecting thereabove. Each of the springs 93 is threaded over the projecting portion of a corresponding one of the rods and is interposed between said top wall 91 and a flange 96 extending from the free end of the rod in question.

The actuator mechanism also includes a finger 97 for positively moving said blade 89 into its lower or thread-pickup position shown in dot-dashed lines. The finger 97 is integral with a sleeve 98 rotatably mounted about a geometrical axis of the housing 100 extending orthogonally to the longitudinal direction of said blade.

In this example, as shown in FIGS. 15 and 18, the suction tube 2 is stepped and is rotatably mounted in a tubular portion 99 of the housing 1, which portion is likewise stepped so as to leave a free space in which the sleeve 98 is rotatably mounted. The portion 99 of the suction tube is prevented from moving in translation by a resilient ring 100, and the sleeve 98 is prevented from moving in translation by the finger 97 which passes through a slot 101 in said portion. For operational purposes, the sleeve 98 is integral with pedals 102 and 103 situated on either side. When the pedal 103 is depressed and the pedal 102 projects upwardly (the position shown in solid lines in FIG. 14 or 17), the finger 97 does not engage the blade 89 so the blade occupies its upper or retracted position. In contrast, when the pedal 9 is depressed and the pedal 93 extends upwardly (the position shown in dot-dashed lines in FIGS. 14 and 17), the finger 97 urges the blade 89 downwardly and holds the blade in its lower or thread-pickup position.

It may be advantageous to amplify the downward stroke of the blade 89 for a normal angular displacement of the control sleeve 98. To this end, the blade 89 may be integrally formed with a rising cam 104 for co-operating with the actuator finger 97 as it pivots.

Naturally, the actuator mechanism may co-operate with two thread-pickup blades, or even more. In addition, retraction may also be applied to the embodiments in which the blade is removable.

I claim:

1. A suction head for a vacuum cleaner comprising:

a housing provided with a suction tube and closed by a bottom sole plate having at least two longitudinal suction channels formed as grooves therein and communicating with the suction tube via at least two openings;

means for picking up fibrous substances including a thread-pickup cloth having oriented fibers;

and at least one blade carrying said thread-pickup cloth;

wherein when said means is in a utilization position, the suction head is used as a vacuum thread-pickup member, and said means is received in at least one of said suction channels selected in said sole plate and at least partially obstructs the corresponding opening, and said blade is positioned so that the fibers of said thread-pickup cloth are oriented towards one of the openings and the tips of the fibers in their rest position are substantially level with the sliding surface of said sole plate.

2. A suction head according to claim 1, wherein said blade is removable and dismountably fixed in its operating position in the selected channel.

3. A suction head according to claim 2, wherein the thread-pickup blade is rectilinear and provided with positioning means to ensure that the fibers are properly oriented.

4. A suction head according to claim 3, wherein the positioning means also constitutes a fixing means.

5. A suction head according to claim 2, wherein the blade carrying the thread-pickup cloth has at least one rib projecting therefrom for being received as a push-fit in the corresponding aperture in order to constitute a dismountable fixing.

6. A suction head according to claim 5, wherein said rib is U-shaped and co-operates with an inwardly directed rim on the sole plate which delimits the corresponding aperture.

7. A suction head according to claim 1, wherein the thread-pickup blade is suitable for being firmly received in the rear channel.

8. A suction heads according to claim 1, wherein one of said two channels has a horizontal aperture and communicates with the other of said two channels via a vertical passage established through a ridge disposed between said two channels.

9. A suction head according to claim 8, in which the aperture in one of the channels through the sole plate extends between ridge portions, and wherein the thread-pickup blade has a forwardly extending middle portion for occupying a position between said ridge portions and for partially obstructing the window.

10. A suction head according to claim 1, wherein the thread-pickup blade is shaped generally as an arc, with its side branches diverging forwardly from a middle branch intended to at least partially obstruct the aperture of the corresponding channel.

* * * * *